US010587078B2

(12) United States Patent
Friesen

(10) Patent No.: US 10,587,078 B2
(45) Date of Patent: Mar. 10, 2020

(54) PLUG CONNECTOR

(71) Applicant: HARTING Electronics GmbH, Espelkamp (DE)

(72) Inventor: Heinrich Friesen, Minden (DE)

(73) Assignee: HARTING ELECTRONICS GMBH (DE)

( * ) Notice: Subject to any disclaimer, the term of this patent is extended or adjusted under 35 U.S.C. 154(b) by 0 days.

(21) Appl. No.: 16/301,684

(22) PCT Filed: Jun. 8, 2017

(86) PCT No.: PCT/DE2017/100484
§ 371 (c)(1),
(2) Date: Nov. 14, 2018

(87) PCT Pub. No.: WO2017/220073
PCT Pub. Date: Dec. 28, 2017

(65) Prior Publication Data

US 2019/0319403 A1 Oct. 17, 2019

(30) Foreign Application Priority Data

Jun. 22, 2016 (DE) ..... 10 2016 111 458

(51) Int. Cl.
*H01R 4/50* (2006.01)
*H01R 13/639* (2006.01)
(Continued)

(52) U.S. Cl.
CPC ..... *H01R 13/639* (2013.01); *H01R 13/6271* (2013.01); *H01R 13/635* (2013.01); *H01R 13/641* (2013.01)

(58) Field of Classification Search
CPC .. H01R 13/639; H01R 13/641; H01R 13/635; F16L 55/1015; F16L 37/23
(Continued)

(56) References Cited

U.S. PATENT DOCUMENTS 3,201,147 A 8/1965 De Cenzo ..... 285/1
4,269,226 A * 5/1981 Allread ..... F16L 37/23 137/614
(Continued)

FOREIGN PATENT DOCUMENTS

CN 101116228 1/2008 ..... H01R 13/428
DE 69804714 2/2003
(Continued)

OTHER PUBLICATIONS

German Office Action (w/machine translation) issued in application No. 10 2016 111 458.8, dated Aug. 21, 2017 (7 pgs).
(Continued)

*Primary Examiner* — Jean F Duverne
(74) *Attorney, Agent, or Firm* — Hayes Soloway P.C.

(57) ABSTRACT

A plug connector which has a main body, an actuator, a latch, and a block. The latch locks a receptacle of a counterpart plug connector by a push-pull mechanism. The latch can be released by actuation of the actuator. The block prevents the latch from moving into a locking position, in the unplugged state of the connector, i.e. without the seated receptacle. Thus, the connector can adopt two static states, an open state and a closed state.

11 Claims, 4 Drawing Sheets

(51) Int. Cl.
*H01R 13/627* (2006.01)
*H01R 13/635* (2006.01)
*H01R 13/641* (2006.01)

(58) Field of Classification Search
USPC ..... 439/347
See application file for complete search history.

(56) References Cited

U.S. PATENT DOCUMENTS

| | | | | | |
|---|---|---|---|---|---|
| 4,865,077 | A * | 9/1989 | Batchen | F16L 37/23 | 137/614.04 |
| 5,564,471 | A * | 10/1996 | Wilder | F16L 55/1015 | 137/614.04 |
| 6,056,577 | A | 5/2000 | Blanchet | 439/352 | |
| 7,329,139 | B2 | 2/2008 | Benham | 439/352 | |
| 9,478,911 | B2 | 10/2016 | Friesen | H01R 13/639 | |
| 9,791,087 | B2 * | 10/2017 | Boothe | F16L 55/1015 | |

FOREIGN PATENT DOCUMENTS

| | | |
|---|---|---|
| DE | 102012111408 | 10/2013 |
| EP | 1703599 | 9/2006 |

OTHER PUBLICATIONS

International Preliminary Report on Patentability issued in application No. PCT/DE2017/100484, dated Jan. 3, 2019 (14 pg).
International Search Report and Written Opinion issued in application No. PCT/DE2017/100484, dated Aug. 28, 2017 (16 pg).
Chinese Office Action (w/translation) issued in application No. 20170039069.7, dated Sep. 19, 2019 (18 pgs).

* cited by examiner

PLUG CONNECTOR

BACKGROUND OF THE INVENTION

Plug connectors are required in order to reversibly connect preferably electrical lines and cables to each other. A reliable electrical and mechanical connection of the plugging partners thus needs to be ensured, Permanent mechanical latching of the plugging partners is just as important as complete connection and contacting of contacts situated inside. Such a type of plug connector can be an electrical, optical, pneumatic, or hydraulic plug connector. The present invention can be applied to any type of plug connector.

As well as mechanically connecting the plug connectors, releasing the connection also needs to be ensured. The mechanical latching thus needs to be completely released without in so doing destroying components of the locking mechanism or the plug connector.

These process of contacting and breaking the contact between plug connectors and the locking mechanism present on the plug connectors have to be repeated many times without affecting the quality of the locking and contacting.

BRIEF DESCRIPTION OF THE PRIOR ART

DE 10 2012 111 408 B3 discloses a locking mechanism for plug connectors with a plugging partner. The locking mechanism here has two types of locking means: a primary locking element which is suitable for locking the plugging partner, and a secondary locking element which is suitable for reciprocal locking to the primary locking element. The secondary locking element thus locks the primary locking element in the locked state of the locking mechanism, and the primary locking mechanism locks the secondary locking element in the unlocked state. As a result of contacting the plugging partner, the mechanism is automatically locked and is unlocked by actuating the secondary locking element designed as an actuator.

A disadvantage of such solutions known from the prior art is the large number of mechanical parts. Many of the known solutions comprise a lot of small parts which together form a very complex, fault-prone device. Devices with many individual parts are naturally more prone to faults and failure.

OBJECT OF THE INVENTION

The object of the invention is therefore to provide a further type of plug connector in order to expand the range of such plug connectors with locking mechanisms. It is proposed that the plug connector has as few individual mechanical parts as possible and that the reliability and likelihood of faults of the device is consequently reduced. It is intended that the individual parts of the mechanical locking mechanism which are present here are as robust as possible and not prone to faults.

SUMMARY OF THE INVENTION

The invention relates to a plug connector for reversible contacting of electrical, pneumatic, optical, or hydraulic lines. The plug connector is here formed by a base body which has a first side and a second side. The first side is designed as a plug-connection face and is provided for contacting a complementary plug connector. The second side of the plug connector is designed as a power-supply side and is provided for receiving lines or cables in the plug connector.

An actuating means and an latching means are provided on the base body of the plug connector. The plug connector moreover has a plug-connection region. The plug-connection region is designed to receive a complementary plug connector. The plug-connection region is the region of the plug connector in which a complementary plug connector engages with its latching or contacting region. This part of the complementary plug connector is usually referred to as a plug-in socket or a so-called receptacle. The plug-connection region of the present invention serves to receive such a receptacle.

The actuating means of the plug connector is preferably designed as a sleeve surrounding the base body. The actuating means thus serves as a handle for the plug connector. The actuating means is here attached movably on the base body and can be shifted between a first closed position and a second open position. The first closed position is in the front region facing the first side of the base body, wherein the second open position of the actuating means is provided in the rear region of the plug connector, facing the second side of the base body.

The two positions, the first closed position and the second open position, simultaneously define the state of the plug connector. Thus, in the first closed position of the actuating means, the plug connector is situated in a closed state. In this closed state, the plug connector is locked or connected to a complementary plug connector and does not release the connection with the complementary plug connector. When the actuating means is situated in the second open position, the plug connector is also in an open state. The locking to a complementary plug connector can be released in this open state.

The latching means of the plug connector is likewise arranged on the base body. It is provided on the plug connector such that it can engage at least in certain places in the plug-connection region. The latching means can lock in place an inserted receptacle of a complementary plug connector by virtue of the latching means engaging in the plug-connection region of the plug connector. The latching of a complementary plug connector, or parts of a complementary plug connector, preferably takes place via a region of the latching means which, in the plug-connection region, engages in a recess of the complementary plug connector or of a receptacle of the complementary plug connector.

For this purpose, the latching means can assume two positions: a first locking position and a second unlocking position. In the first locking position, the latching means engages at least in certain places in the plug-connection region of the plug connector, i.e. the latching means is situated at least partially in the plug-connection region and engages there in a receptacle. It is thus situated in a recess of the receptacle such that the latter is prevented from moving. At the same time, in the first locking position, the latching means frees the movement region of the actuating means. In the first locking position, the latching means preferably frees the movement region of the actuating means in its first closed position. The actuating means can thus be moved freely from its second open position and first closed position without the latching means obstructing the actuating means.

The actuating means is here configured such that, in its first closed position, it blocks the latching means in its first locking position. The latching means can hence not be moved from the first locking position into the second unlocking position when the actuating means is situated in the first closed position. According to the invention, a first spring is provided for this purpose which effects a forced movement of the actuating means into its first closed position, i.e. the actuating means is forced by the first spring constantly into the first closed position as long as the latching means does not obstruct it.

In the second unlocking position, the latching means behaves in an opposite fashion with respect to the plug-connection region and the actuating means. In its second unlocking position, the latching means completely frees the plug-connection region of the plug connector and does not engage in the latter. A receptacle or complementary plug connector can move freely into and out of the plug-connection region.

However, in its second unlocking position, the latching means engages in the movement region of the actuating means in its first closed position. This means that the latching means is situated in the movement region of the actuating means such that the actuating means cannot move from its second open position into its first closed position. The actuating means is hence blocked in its second open position by the latching means which is situated in the second unlocking position.

The actuating means and the latching means hence block each other reciprocally, depending on the position in which they are situated. In its first closed position, the actuating means blocks movement of the latching means from its first locking position into its second unlocking position. In contrast, in its second unlocking position, the latching means blocks movement of the actuating means from its second open position into its first closed position.

According to the invention, the plug connector has a blocking means which is arranged in the plug-connection region of the plug connector. The blocking means can assume a first blocking position and a second unblocking position. The first blocking position is here preferably oriented closer to the first side of the plug connector, and the second unblocking position further from the second side of the plug connector. There would hence advantageously be a linear movement of the blocking means between the two positions. However, rotational or tilting movements would also be conceivable in other embodiments. The blocking means behaves in a similar fashion to the actuating means. This means that the movement of the latching means can be blocked by the blocking means.

In its first blocking position, the blocking means hence blocks the movement of the latching means. In this first blocking position, the blocking means is situated at least in certain places in the movement space of the latching means in its first locking position. This means that the latching means cannot move from its second unlocking position into its first locking position when the blocking means is situated in its first blocking position.

The latching means can be moved into its first locking position only when the blocking means is situated in its second unblocking position. According to the invention, a second spring which effects a forced movement of the blocking means into its first blocking position is additionally provided on the plug connector, i.e. the blocking means is constantly forced into the first blocking position unless a greater force prevents it from doing so.

A preferred embodiment provides that not just one latching means but a plurality of latching means are attached on the plug connector. The plurality of latching means are preferably evenly distributed over the circumference of the plug connector. As a result, a force can be transmitted uniformly onto and by the complementary plug connector in the closed state of the plug connector. Wedging of the plug connector is thus prevented. The plurality of latching means can also be designed at least partially as a single piece. Depending on the design of the latching means, two or more latching means can thus take the form of a component. This would advantageously reduce the large number of individual parts of the plug connector.

The embodiment of the latching means can thus vary depending on the technical design. Latching means have been shown to be particularly advantageous which can move in a tiltable or pivotable fashion between their first locking position and their second unlocking position. However, solutions with linearly movable latching means are also conceivable. The plug connector expediently has two display means, a first display means and a second display means. The display means are here designed to display the state. Depending on which of the display means is visible, a different status of the plug connector is signaled. The first display means is here covered by the actuating means in the second open position. In contrast, in the first closed position, the actuating means covers second display means. The corresponding display means is thus covered or uncovered depending on the position of the actuating means, which defines the status of the plug connector.

By virtue of the plug connectors described in the invention, the disadvantages known from the prior art are overcome and the object defined and set out in the invention is achieved.

BRIEF DESCRIPTION OF THE DRAWINGS

An exemplary embodiment of the invention is shown in the drawings and explained in detail below. In the drawings.

The drawings contain partially simplified schematic views. In part, identical reference numerals are used for the same but possibly non-identical elements. Different views of the same elements can be shown at different scales.

DETAILED DESCRIPTION OF THE INVENTION

Figure 1:
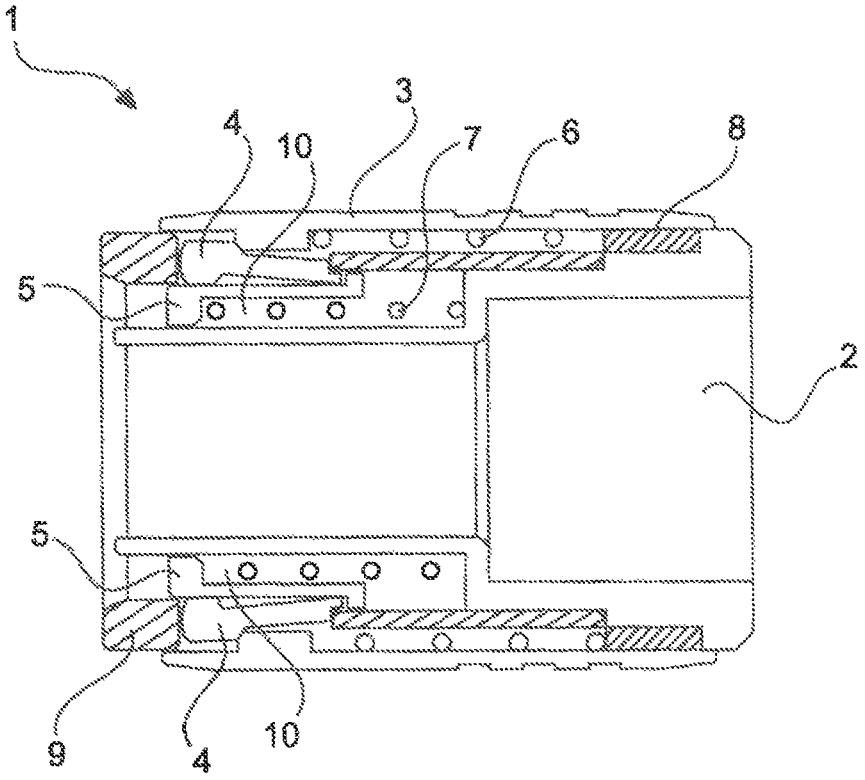
FIG. 1 shows a view in section of a plug connector according to the invention.

FIG. 1 shows a view in section of a plug connector 1 according to the invention along a plugging axis in an open state. The side shown on the left here forms a first side of the plug connector 1 which is designed as a plug-connection face, i.e. for contacting a complementary plug connector. The side shown on the right forms a second side of the plug connector 1 which is designed as a power-supply side, i.e. for the insertion and contacting of a power-supply cable. The plug connector 1 shown in the exemplary embodiment takes the form of a circular plug connector.

The plug connector 1 is formed from a base body 2 which forms the first side and the second side of the plug connector. The insulating bodies and contact elements provided and accommodated inside the base body 2 are not shown in this and subsequent views for the sake of clarity.

The base body 2 is surrounded by an actuating means 3. The actuating means 3 is attached such that it can be shifted linearly along the plugging axis of the plug connector 1 on the base body 2. The actuating means 3 can thus assume a first closed position and a second open position (which is shown). In the first closed position, the actuating means 3 is arranged further toward the first side of the plug connector 1, i.e. the left in this case. In the second open position (as shown), the actuating means 3 is arranged further toward the second side of the plug connector 1, i.e. the right in this case, as can be seen in FIG. 1. This advantageous positioning of the actuating means 3 serves primarily for handling when the plug connector 1 is plugged onto a complementary plug connector and pulled off it. The actuating means 3 is here always positioned in the direction in which the plugging or pulling-off movement is directed: when plugging in, in the first closed position in the plugging direction and when pulling off, in the second open position counter to the plugging direction. This principle is known as the so-called push-pull principle.

In order to achieve compulsory locking of the plug connector 1, a first spring 6 is associated with the actuating means 3. The first spring 6 exerts a constant force on the actuating means 3 and the base body 2. The force is directed such that the actuating means 3 is constantly forced into its first closed position. Movement of the actuating means 3 into the second open position can thus take place only counter to the spring force of the first spring 6.

In the front region, facing the first side, of the plug connector 1, two latching means 4 are accommodated on the base body 2, inside the actuating means 3. The latching means 4 are arranged in a bitable or pivotabie fashion on the base body 2. The latching means 4 can here assume two positions: a first locking position and a second unlocking position (which is shown). In the second unlocking position which is shown, the latching means 4 are arranged at least in certain places in the movement region of the actuating means 3. The latching means 4 are tilted radially outward and project at least in certain places in front of the actuating means 3, As a result, the latching means 4 block the actuating means 3. Movement of the actuating means 3 from its second open position into its first closed position is not possible.

According to the invention, a blocking means 5 is additionally arranged on the plug connector 1, The blocking means 5 here has an annular design and engaging around the base body 2 of the plug connector 1. The blocking means 5 is provided in the front region, on the first side of the plug connector 1, and accommodated in a plug-connection region 10, The plug-connection region 10 on the first side of the plug connector 1 is designed for receiving and mechanically latching a complementary plug connector 1. The so-called receptacle, the plug-in socket of the complementary plug connector, is thus inserted and mechanically latched in the plug-connection region 10.

The blocking means 5 is accommodated on the base body 2 so that it can move linearly between a first blocking position and a second unblocking position. The first blocking position thus lies toward the first side of the plug connector 1, and the second unblocking position toward the second side of the plug connector 1. A force is exerted on the blocking means 5, which forces the latter constantly into its first blocking position, via a second spring 7 which is arranged between the blocking means 5 and the base body 2.

In the first blocking position shown of the blocking means 5, the latter is positioned in the movement region of the latching means 4. The blocking means 5 thus blocks the latching means 4 in their second unlocking position. Movement of the latching means 4 from the second unlocking position into the first locking position is not possible.

Figure 2:
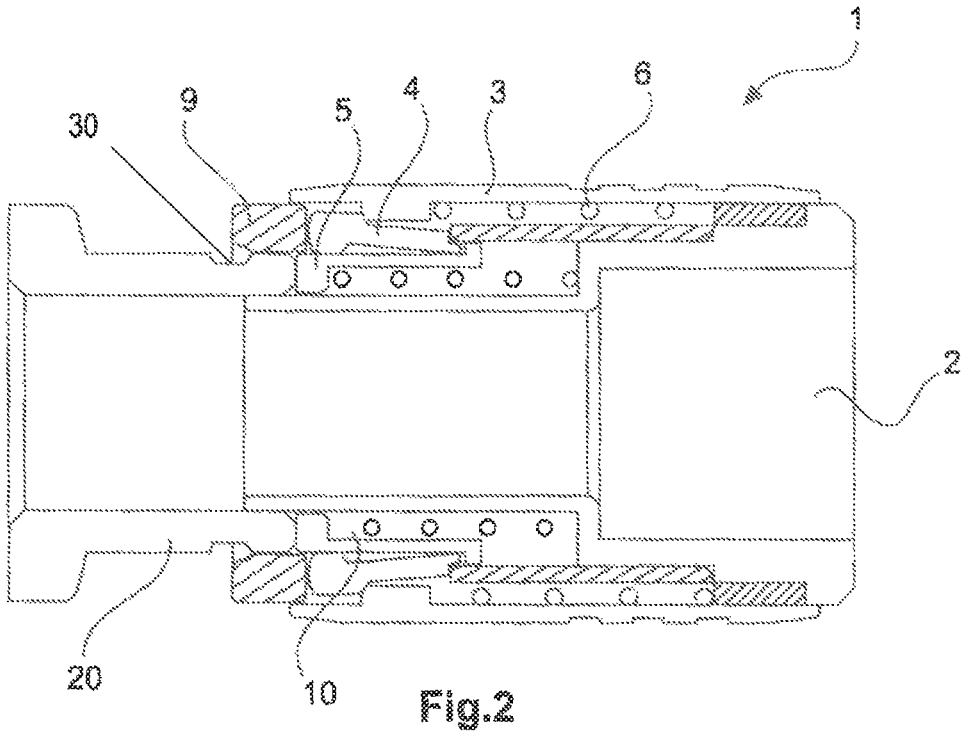
FIG. 2 shows a view in section of a plug connector according to the invention, with a receptacle of a complementary plug connector.

FIG. 2 shows a view in section of a plug connector 1 according to the invention with a receptacle 20 of a complementary plug connector. The receptacle 20 of the complementary plug connector is here the part which serves for mechanically latching the plug connector 1 and the complementary plug connector. In FIG. 2, the receptacle 20 is partially inserted into the plug-connection region 10 of the plug connector 1. The plug connector is situated in the same open state as in FIG. 1. The receptacle 20 bears at the front against the blocking means 5 of the plug connector 1, which is situated in the plug-connection region 10.

Figure 3:
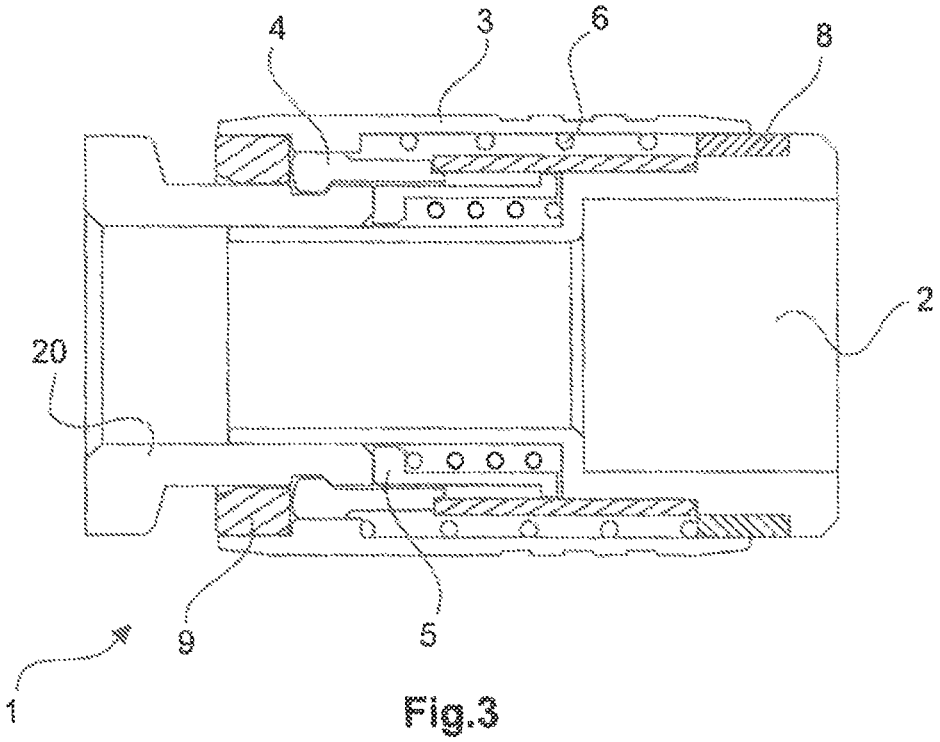
FIG. 3 shows a view in section of a plug connector according to the invention, with a receptacle of a complementary plug connector in the connected, closed state.

FIG. 3 shows a view in section of a plug connector 1 according to the invention with a receptacle 20 of a complementary plug connector in a connected closed state. In this closed state, the receptacle 20 is pushed further into the plug-connection region 10 of the plug connector 1. The blocking means 5 has also been shifted from its first blocking position into its second unblocking position by the receptacle 20. The blocking means 5 is here displaced counter to the spring force of the second spring 7.

Because in this position the blocking means 5 no longer blocks the movement of the latching means 4, the latter is moved into its first locking position. In the first locking position (which is shown), the latching means 4 engages into the plug-connection region 10 of the plug connector 1 such that it engages into a recess or groove 30 of the receptacle 20. The actuating means 3 is likewise moved into its first closed position. In this position, the actuating means 3 blocks the latching means 4 in its first locking position. The latching means 4 is thus no longer able to release the receptacle 20. Locking of the plug connector 1 to the complementary plug connector is ensured.

The contact regions between the latching means 4 and the actuating means 3, and between the latching means 4 and the receptacle 20 or blocking means 5, are designed such that the actuating means 3, receptacle 20, and blocking means 5 effect a movement of the latching means 4 depending on the position. When it moves from its second open position into its first closed position, the actuating means 3 thus exerts a force on the latching means 4, which moves the latter from its second unlocking position into its first locking position. In contrast, when it moves in the plugging-in direction, i.e. from the second side toward the first side of the plug connector 1, the receptacle 20 and the blocking means 5 exert a force on the latching means 4, which moves the latter from its first locking position into its second unlocking position.

In the present invention, these interdependencies between the actuating means 3, the latching means 4, the blocking means 5, and the receptacle 20 effected a particularly advantageous locking, which defines two additional states of the plug connector 1. The first closed state in which the plug connector 1 is connected to the complementary plug connector. The latching means 4 locks the receptacle 20 and the actuating means 3 blocks the latching means 4. In the second open state, the plug connector 1 is open and not connected to the complementary plug connector. The latching means 4 blocks the actuating means 3 in its second open position and the blocking means 5 blocks the latching means 4 in its second unlocked position.

Figure 4A:
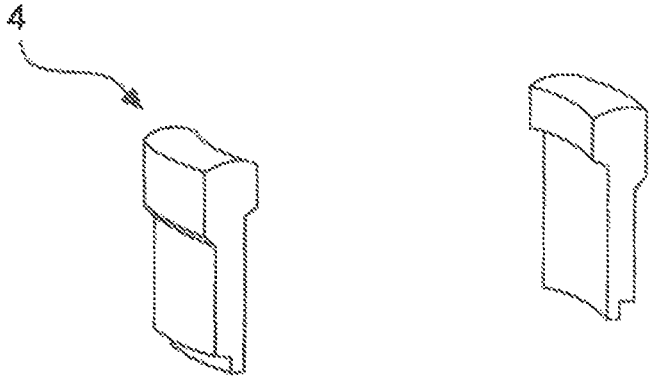
FIGS. 4*a*, 4*b* and 4*c* show different embodiments of individual latching means
Figure 4B:
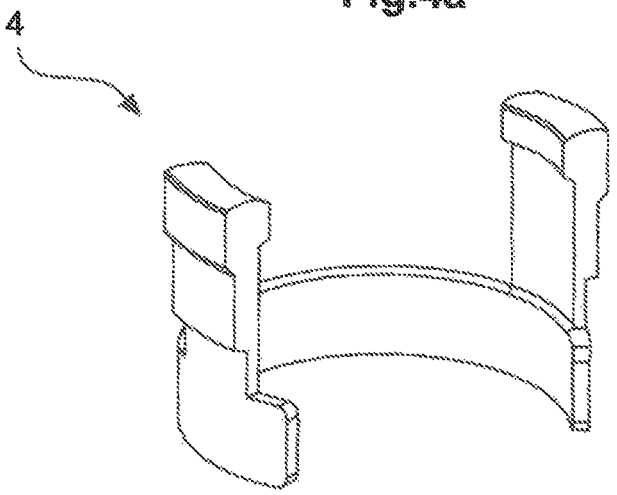

FIG. 4 shows different embodiments of individual latching means 4. Thus, in FIG. 4*a* two latching means 4 are shown which are accommodated individually on a plug connector 1. FIG. 4*b* shows an alternative embodiment in which two latching means 4 are designed as a single piece. The latching means 4 are here connected via a ring. In this embodiment, only one part needs to be installed when assembling the plug connector 1.

Figure 4C:
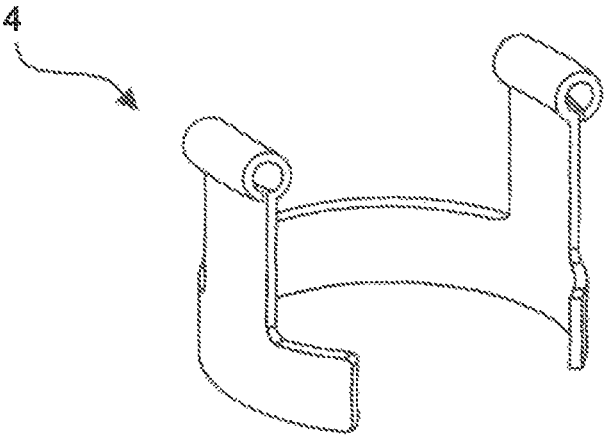

FIG. 4*c* shows an latching means 4 as shown in FIG. 4*b* but produced in a different fashion. Whilst the latching means 4 in FIGS. 4*a* and 4*b* are designed as solid parts, the latching means 4 is produced as a stamped and formed part. Such a type of production would be more economic for higher volumes.

Figure 5A:
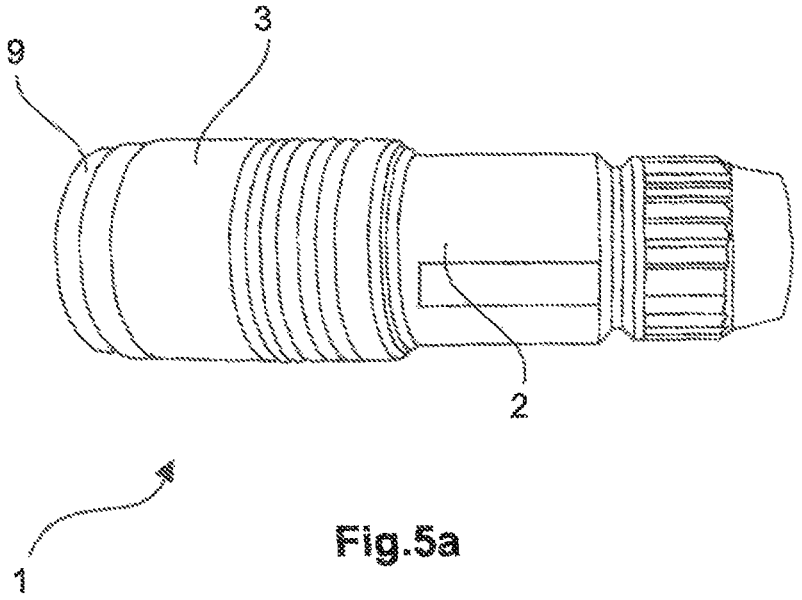
FIGS. 5*a* and 5*b* show a plug connector according to the invention in different states.
Figure 5B:
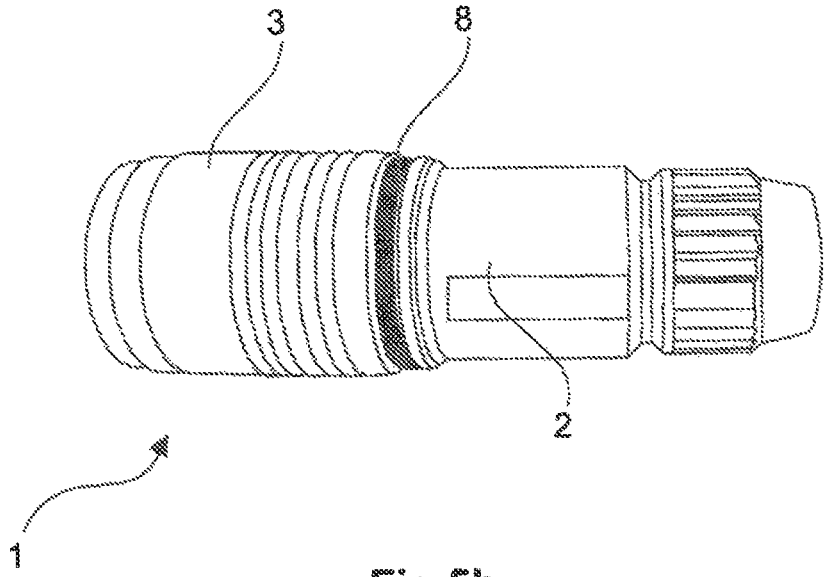

Lastly, a plug connector 1 according to the invention is illustrated in different states in FIG. 5. The plug connector 1 is shown in an open state in FIG. 5*a*, whilst the plug connector 1 is shown in FIG. 5*b* in a closed state. In the three-dimensional view, the only visible difference is in the position of the actuating means 3. In order to make it possible to visually identify the states, a first display means 8 and a second display means 9 are applied to the plug connector 1.

The display means 8, 9 take the form of colored markings on the base body 2. Depending on the position of the actuating means 3, one of the display means 8, 9 is visible, whilst the other display means 9, 8 is covered. It is thus possible to identify the state of the plug connector 1 particularly easily.

The invention claimed is:

1. A plug connector, having a base body with a first side designed as a plug-connection face, and a second side designed as a power-supply side, an actuator configured to be shifted along the base body, a plug-connection region, and at least one latch, wherein the actuator is configured to assume a first closed position and a second open position, wherein the latch is configured to assume a first locking position and a second unlocking position, wherein, in the first locking position, the latch engages at least in certain places in the plug-connection region and releases the movement region of the first closed position of the latch, wherein, in the second locking position, the latch releases the plug-connection region and engages at least in certain places in the movement region of the first closed position of the actuator, wherein, in its first closed position, the actuator engages in the movement region of the second locking position of the latch and blocks the latch in its first locking position, wherein the plug connector has a block which is arranged in the plug-connection region of the plug connector and configured to assume a first blocking position and a second unblocking position, and the first blocking position, the block blocks the latch in its second unblocking position.

2. The plug connector as claimed in claim 1, wherein, in the second unblocking position, the block releases the latch to at least in certain places engage in the plug-connection region.

3. The plug connector as claimed in claim 1, wherein the plug connector has at least one first spring, wherein the first spring effects a forced movement of the actuator into the first closed position.

4. The plug connector as claimed in claim 1, wherein the plug connector has at least one second spring, wherein the second spring effects a forced movement of the block into the first blocking position.

5. The plug connector as claimed in claim 1, wherein at least two latches are arranged so that they are distributed over a circumference of the base body.

6. The plug connector as claimed in claim 5, wherein the at least two latches are designed as a single piece and are connected to each other via a connecting region.

7. The plug connector as claimed in claim 1, wherein latch is configured to move in a tillable or pivotable fashion between the first locking position and the second unlocking position.

8. The plug connector as claimed in claim 1, wherein the first blocking position of the block is situated further toward a first side of the base body and the second unblocking position of the block is situated further toward a second side of the base body, wherein the block is configured to move linearly between the first blocking position and the second unblocking position.

9. The plug connector as claimed in claim 1, wherein the first closed position of the actuator is situated further toward a first side of the base body and the second open position of the actuator is situated further toward a second side of the base body, wherein the actuator is configured to move linearly between the first closed position and the second open position.

10. The plug connector as claimed in claim 1, wherein the plug connector has a first display and a second display, wherein the first display is covered by the actuator in the second open position, and wherein the second display is covered by the actuator in the first closed position.

11. The plug connector as claimed in claim 1, wherein when the actuator moves from its second open position into its first closed position, the actuator exerts a force on the latch which effects a movement of the latch from its second unlocking position into its first locking position.

* * * * *